United States Patent [19]

Nohl et al.

[11] Patent Number: 4,598,506

[45] Date of Patent: Jul. 8, 1986

[54] SWIMMING POOL COVER

[76] Inventors: Arthur H. Nohl; DeWayne A. Nohl; Alvin L. Nohl, Jr., all of Box 214, Hancock, Minn. 56244

[21] Appl. No.: 647,610

[22] Filed: Sep. 5, 1984

[51] Int. Cl.[4] ..... E04B 7/16

[52] U.S. Cl. ..... 52/66; 4/498; 52/122.1; 52/169.7; 254/387

[58] Field of Search ..... 52/66, 125.1, 122.1, 52/169.7, 169.8, 745; 4/498, 500, 501; 254/214, 223, 247, 257, 387, 321, 310, 376

[56] References Cited

U.S. PATENT DOCUMENTS

| | | | |
|---|---|---|---|
| 957,094 | 5/1910 | Ratledge, Sr. | 254/387 X |
| 1,164,898 | 12/1915 | Whelen | 254/387 X |
| 2,472,887 | 6/1949 | Core | 254/387 X |
| 2,508,679 | 5/1950 | McClellan et al. | 52/745 X |
| 2,671,638 | 3/1954 | Allen | 254/387 |
| 2,767,013 | 10/1956 | Spears | 254/387 X |
| 3,045,253 | 7/1962 | Price | 4/501 X |
| 3,086,219 | 4/1963 | Stafford | 4/501 |
| 3,091,777 | 6/1963 | Pearlson | 4/172 |
| 3,114,153 | 12/1963 | Pierson | 4/172 |
| 3,118,148 | 1/1964 | Taylor et al. | 4/172 |
| 3,179,374 | 4/1965 | Wälli | 52/125.1 X |
| 3,273,859 | 9/1966 | Wälli | 52/125.1 X |
| 3,395,777 | 8/1968 | Rodosta | 254/387 X |
| 3,566,420 | 3/1971 | Peterson et al. | 4/172.11 |
| 4,006,567 | 2/1977 | Flannery | 52/126 |
| 4,037,385 | 7/1977 | Wahlquist | 52/745 |
| 4,078,293 | 3/1978 | Aine | 29/416 |
| 4,106,134 | 8/1978 | Schiron et al. | 4/172.13 |
| 4,135,259 | 1/1979 | Scardenzan | 4/172.11 |
| 4,164,047 | 8/1979 | Barothy | 4/500 X |
| 4,165,543 | 8/1979 | Reinert | 4/500 |
| 4,426,744 | 1/1984 | Love | 4/500 X |

FOREIGN PATENT DOCUMENTS

| | | | |
|---|---|---|---|
| 278909 | 10/1914 | Fed. Rep. of Germany | 254/214 |
| 2806175 | 8/1979 | Fed. Rep. of Germany | 52/122.1 |
| 1014078 | 8/1952 | France | 254/387 |
| 2408705 | 7/1979 | France | 52/169.7 |
| 441634 | 11/1948 | Italy | 254/387 |
| 166802 | 7/1921 | United Kingdom | 254/247 |

*Primary Examiner*—Alfred C. Perham
*Assistant Examiner*—Jean M. LaKemper
*Attorney, Agent, or Firm*—Kinney & Lange

[57] ABSTRACT

A swimming pool cover for an indoor pool which is designed to cover an in-ground pool that is positioned below floor level in a manner so that it provides a support floor when in place that is merely a continuation of the existing floor and which can be raised up vertically when the pool is to be used and become a false ceiling. The cover is provided with vertical guides that prevent it from twisting or coming out of proper orientation, and the guides have safety ratchets that prevent the pool cover from accidentally lowering. The hoist mechanism is stored out of sight in a crawl space or attic above the normal ceiling and operates through cables and pulleys for positively moving the pool cover between its raised and lowered position so that the pool, when covered, provides floor space for a recreation room or party room and also tends to seal the water surface to prevent excessive moisture from escaping into the room.

13 Claims, 9 Drawing Figures

SWIMMING POOL COVER

BACKGROUND OF THE INVENTION

1. Field of the Invention

The present invention relates to swimming pool covers for in-ground, interior pools.

2. Description of the Prior Art

Swimming pool covers that will lift out of position have been known in the prior art. U.S. Pat. No. 3,566,420, issued to Peterson et al. on Mar. 2, 1971 comprises a combination pool cover and submergible dressing room. The cover is raised up and down with hydraulic cylinders that are embedded in the walls of the pool, and that a hand crank arrangement using pulleys can be used in place of the hydraulic cylinders to raise and lower the cover. In any event, however, it includes a dome type roof for shedding rain, but with the moving mechanism recessed below the level of the ground.

U.S. Pat. No. 4,078,293, issued to Aine on Mar. 14, 1978 shows a rigid swimming pool cover that is made out of suitable material and fits against the edges of the pool to provide a shield for keeping debris and the like out of the pool. Several variations of the pool cover are shown, and each shows a type of a foam material. This too is for outdoor pools, and deals with the forming of the cover. A lifting mechanism for the cover is shown in FIG. 4 of the patent which comprises a type of a drive including a chain that will move a column upwardly to lift the cover.

Ceilings which raise and lower are shown in U.S. Pat. No. 4,006,567, issued Feb. 8, 1977 to Flannery wherein a false ceiling is supported in a parallel spaced relationship to the floor and can be moved up and down by operating electric motors. It is used for varying the height of the ceiling, but not for covering any pool.

U.S. Pat. No. 4,037,385 also shows a portable room that has a movable ceiling or cover for this room that can be raised and lowered once the partitions forming the room are in place.

U.S. Pat. No. 4,135,259, issued Jan. 23, 1979 to Scardenzan shows a deck structure that is used as a pool cover and is disclosed as being capable of supporting weight. It can serve as a deck in either the open or closed positions. Linkages are used for supporting the cover and a hydraulic cylinder is actuated for pivoting the linkage to raise and lower the cover.

U.S. Pat. No. 3,114,153, issued Dec. 17, 1963 to Pierson, and U.S. Pat. No. 3,118,148, issued Jan. 21, 1964 to Taylor et al. show combination devices that can be swimming pools or bomb shelters and have covers. U.S. Pat. No. 3,114,153 shows a cover that is used for supporting weight and which rolls into place on rollers. In other words it is offset laterally when it is in its open position oncovering the pool or shelter. U.S. Pat. No. 3,118,148 shows a cover that is folded in sections like a "accordian".

U.S. Pat. No. 3,091,777, issued to Pearlson on June 4, 1963 shows a swimming pool cover that is submerged, and comes up from the bottom of the pool so that during use it forms the bottom of the pool, and U.S. Pat. No. 4,106,134, issued to Schiron et al. on Aug. 15, 1978 also shows a false bottom or floor that lifts up to form a type of a cover, and during use is at the bottom of the pool.

SUMMARY OF THE INVENTION

A swimming pool cover for an indoor swimming pool has an upper surface which is flush with the floor surface of the room in which the swimming pool is placed, and which can be raised through a suitable mechanism to a position wherein it is substantially above the pool so the pool can be used. The pool cover is sturdy enough to provide a floor surface when in place covering the pool, so that the room can be used for normal use such as recreation room for a dance floor or the like.

The lifting apparatus includes a winch that operate cables to raise and lower the pool cover. The pool cover is guided by suitable upright guides that stabilize the cover and prevent it from twisting or swaying, and further include safety latches that prevent falling of the cover unless it is desired that such reverse movement be permitted (when the cover is lowered). Mechanical latches are used so that during the raising if a cable breaks it would not cause any damage. Upon raising the pool cover to the desired height, the latches can be used for holding the cover in place and then when the pool cover is to be lowered, the cover may first be raised to a full height where the one set of latches is disabled, after which the pool cover can be lowered, without the latches engaging.

The lift cables also are connected to the pool cover through spring loaded safety catches which are held disengaged when the cables are under tension, but as soon as tension is gone the latches will engage to prevent accidental dropping of the pool cover.

During the lowering operation the main latches are disengaged, but, during that time the operators and others will be out of the way because the pool is going to be covered, and the cable tension sensitive latches are still operable. When the pool cover is fully lowered the latch is reset mechanically so that it will be operable the next time the pool cover is raised.

The floor is made so that it is rigid enough to provide adequate suport, and because it is guided into position it fits easily within the recess. The vertical guides also reduce any tendency of the unit to twist or spin, thereby reducing the likelihood of any component failure during the raising and lowering operations.

DETAILED DESCRIPTION OF THE PREFERRED EMBODIMENTS

Figure 2:
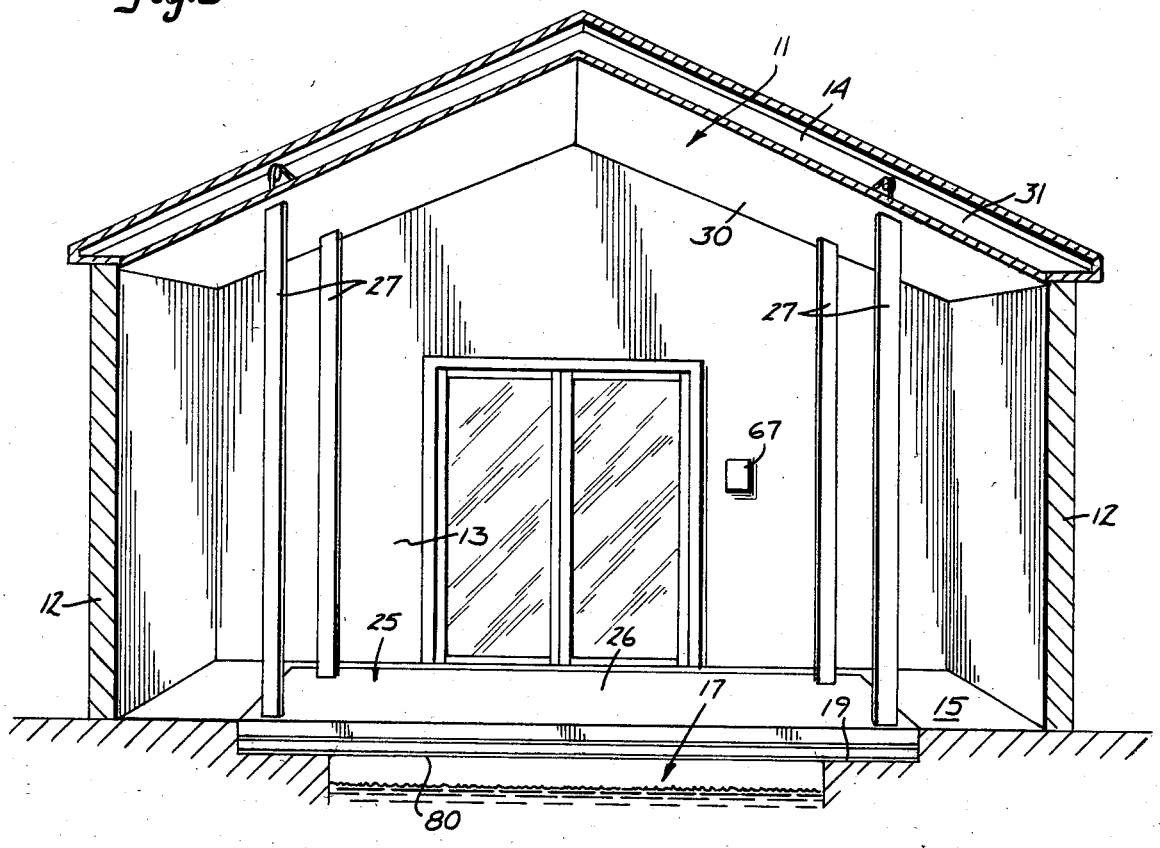
FIG. 2 is a vertical sectional end view of the room showing the swimming pool cover of FIG. 1.
Figure 3:
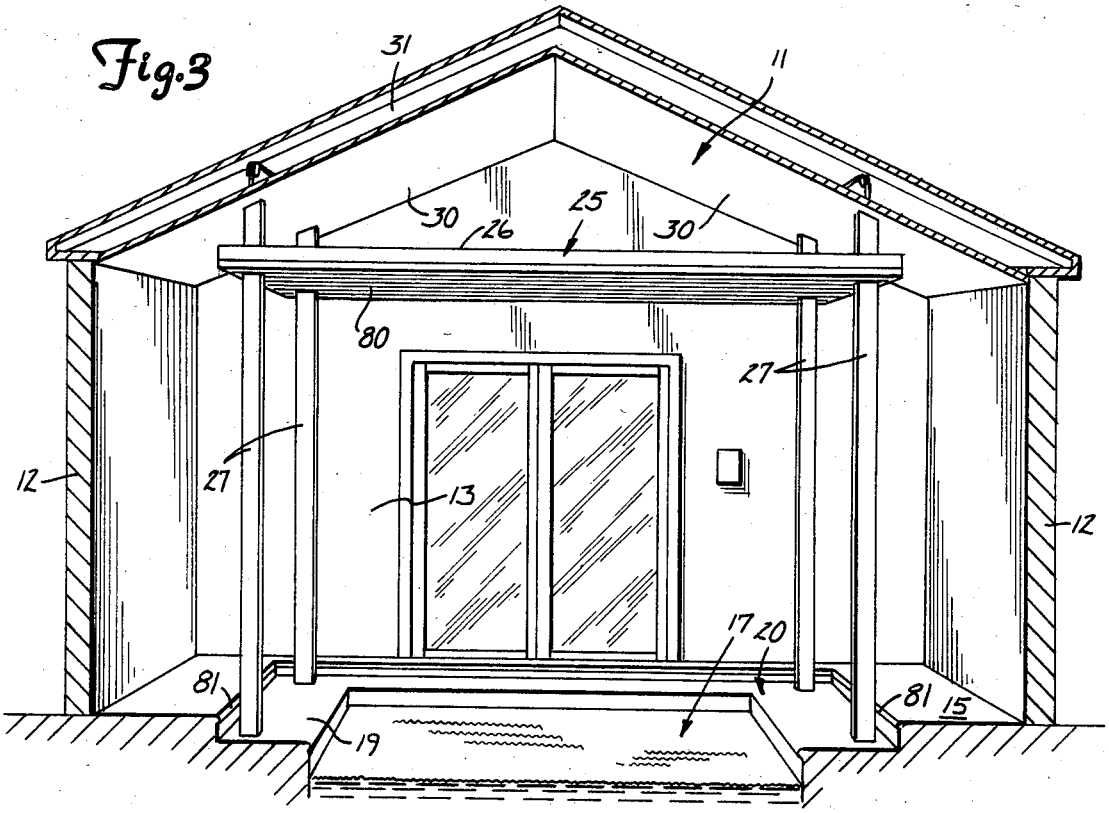
FIG. 3 is a sectional view taken along the same lines as FIG. 2 showing the swimming pool cover in a raised position.

By way of illustration, a house or building indicated generally at 10 is constructed to have a room 11 with enclosing walls 12 and 13 and a roof structure 14. The room further has a floor 15, surrounding an in-ground, indoor swimming pool the upper portions of which are shown at 17 in FIGS. 2 and 3.

The pool as shown is generally rectangular in plan view, and is spaced inwardly from the side walls 12 so that the floor 15 forms a perimeter around the pool 17.

As shown, the floor 15 has a recess indicated at 20 formed around the perimeter of the pool 17. The recess defines a perimeter support surface 19 around the pool. A pool cover indicated at 25 is made so that when it is resting on the support surface 19 of the recess 20 it overlies the pool 17, and the upper surface of the floor layer 26 of the pool cover lies flush with the surface of floor 15. The pool cover is made to have adequate strength to support people on the top so that the pool cover, when in place, permits use of the room 11 defined by the walls 12 and the end walls 13 for a recreation room or for other uses. The upper surface 26 of the pool cover can be covered with the same floor covering as the rest of the floor.

The raising and lowering of the pool cover 25 is guided by a plurality of upright guide columns indicated generally at 27 which are placed at the sides of the pool. As shown, these upright guide columns 27 are fixed with respect to the floor 15 and extend upwardly to be attached to a ceiling indicated generally at 30 which is immediately below the rafters 31 forming the roof structure of the room.

The upright guide columns 27 pass through an opening in the pool cover 25 at the corners, and suitable framing is made in the cover member 25 so that the upright columns act as guides for the cover. The means for lifting and lowering the pool cover are attached to the cover at these locations as well. The columns 27 also provide means for mounting safety devices to prevent accidental dropping of the cover.

Figure 4:
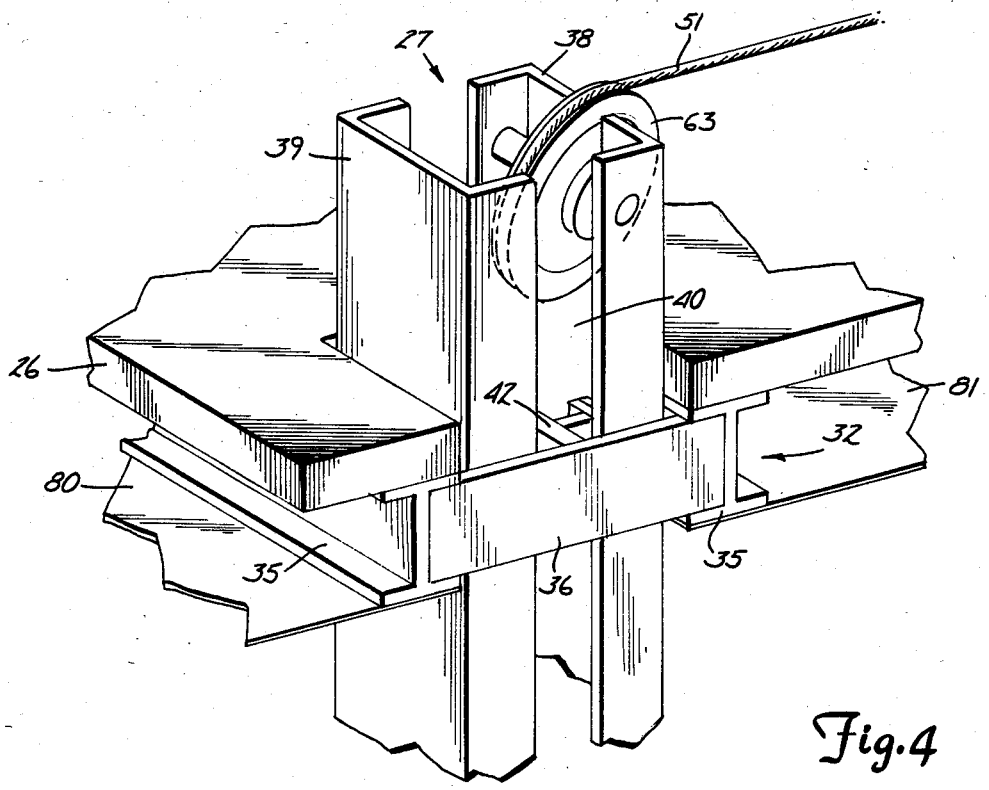
FIG. 4 is a fragmentary enlarged perspective view of an upright guide column made according to the present invention used for guiding and restraining the swimming pool cover as it is moved between its working and raised positions.
Figure 5:
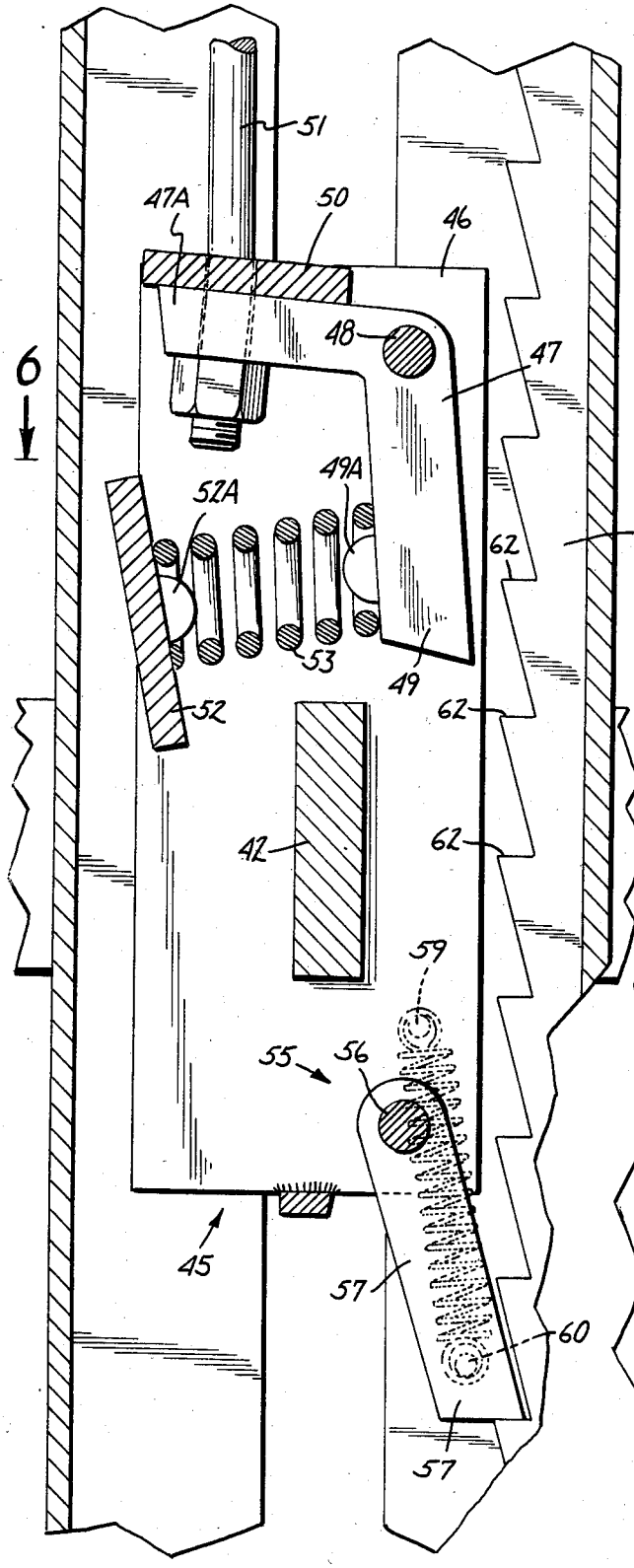
FIG. 5 is a side sectional view showing a housing used for guiding the swimming pool cover in a vertical guide.
Figure 6:
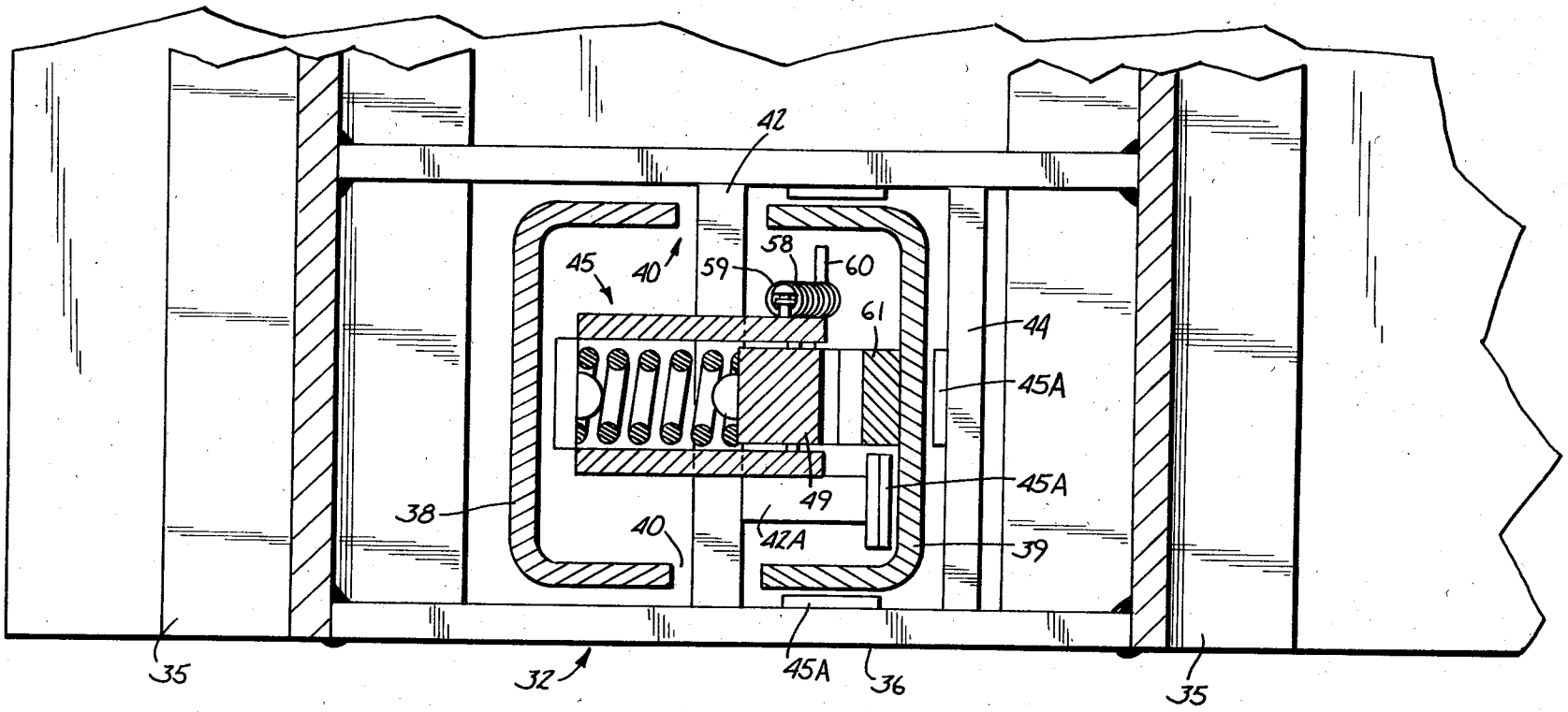
FIG. 6 is a sectional view taken as on line 6—6 in FIG. 5.
Figure 7:
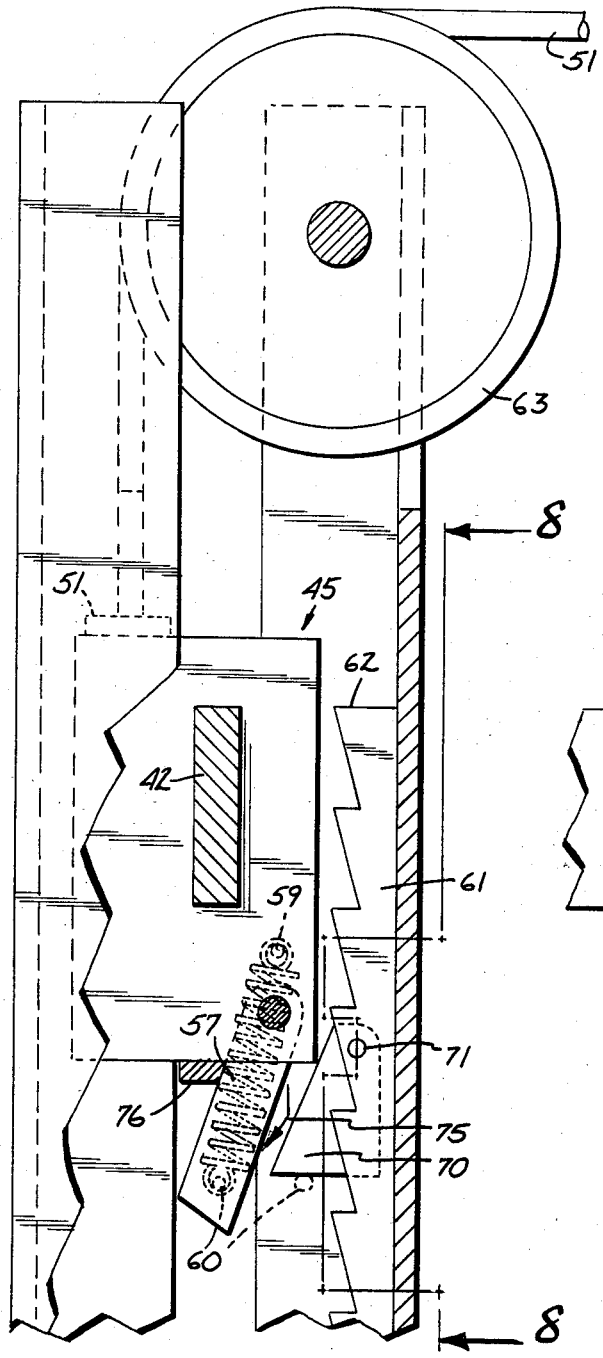
FIG. 7 is a side elevational view showing a mechanism for disengaging a safety latch at the upper end of the movement of the swimming pool cover where it is.

In FIGS. 4, 5 and 6, a typical pool cover support and guide assembly is shown at 32. The swimming pool cover 25 is made up of a plurality of cross beams 35, which are spaced at regular intervals along the length of the cover and which extend across and are supported on the recess surface. A floor material layer 26 is supported on the beams 35. In the region of the upright supports there are braces or cross members 36 attached to two cross beams to form a guide assembly boxing in the respective upright columns 27. The cross members 36,36 are placed on opposite sides of the upright support 27 and the cross members 35 extend along the other sides of the column. The members 36,36 closely slidably fit along the sides of the upright guide columns 27, and as shown the guides 27 each comprise a first upright channel member 38, and a second channel member 39 that have their legs facing the legs of the other channel and spaced from the other legs to define a longitudinally (vertically) extending slot 40. The guides do not have to be channels, but the guide slot 40 provides a space in which a retainer arm 42 moves for guide and restraint. The retainer arm 42 is fixed suitably, such as by welding, to the cross members 36,36 and extends parallel to the members 35,35. The cross member 42 is a rectangular shaped bar as shown in FIG. 7, and fits within the slot 40 in a suitable manner.

The cross members 36,36 also support end guide walls 44,44 that are on opposite sides of the upright beams and parallel to cross member 42. A guide arm 42A extends from member 42 on the respective interior of the upright columns 27. Suitable low friction guide strips 45A are provided on the surfaces of the walls 44 which face the respective upright guide columns 27 and on the end of guide arm 42A, in suitable location for guiding the pool cover 25 along the respective upright column 27 to provide anti-friction or low friction bearing surfaces for the two sliding parts.

As shown in FIGS. 5 and 6, the cross member 42 is used for supporting a cable control housing 45. The housing 45 comprises a pair of spaced apart plates 46,46 that are fixed to the cross member 42 in a suitable manner and these plates in turn have a cross member 50 at the upper end thereof which is welded to the plates. A lift cable 51 is passed through the cross member 50 and is connected to a bell crank 47 for providing the lifting and lowering cable attachment for the swimming pool cover.

The bell crank 47 is pivoted on a shaft 48 which is mounted on side plates 46 and the bell crank is positioned between the plates 46. The bell crank has a safety latch dog or leg 49 that extends downwardly. The cable 51 is suitably connected to the other leg 47A of the bell crank 47 and when the cable 51 is under tension the leg 47A will butt on plate 50 to lift the housing 45 and thus the pool cover. A spring mounting plate 52 is fixed to plates 46 and plate 52 has a pin 52A mounting a compression spring 53 which mounts over a pin 49A of leg 49 and acts to urge the leg 49 toward an upright ratchet rack 61 attached to the guide column 27. The spring 53 is compressed by the cable tension and when lifting the pool cover the bell crank is mechanically stopped by plate 50 with the latch leg 49 held away from the ratchet rack 61.

Figure 8:
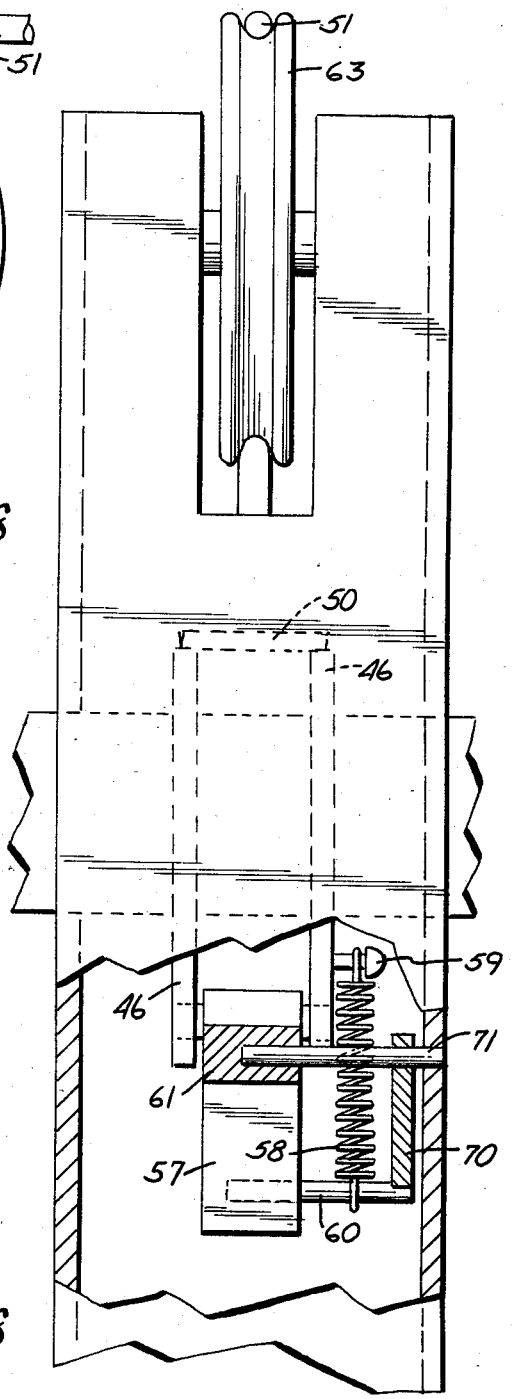
FIG. 8 is a sectional view taken generally along line 8—8 in FIG. 7.

The lower portions of the plates 46 are used for mounting a separate safety catch assembly indicated generally at 55. A suitable cross shaft 56 is coupled between the plates 46 and mounts a relatively wide dog member 57 that is spring loaded with a tension spring 58, attached to a pin 59 attached to one of the side plates 46. A pin 60 is also fixed to the dog 57. The pins 59 and 60 extend laterally of plates 46, as shown in FIG. 8 and as shown in FIG. 5 the pins 59 and 60 are positioned so that when the dog 57 is normally urged toward the rack 61 that has rack teeth 62 defined therein. A separate rack 61 is fixed to and extends the full length of each of the guide columns 27, and as tension is placed on the cables (each of the guide columns 27 has the cable housing and cable therein) and as the pool cover is raised, the dog 57 will ratchet up the teeth 62 until it is reset to permit reverse movement, as will be explained.

Each cable 51 in each of the guide columns, extends upwardly through the column and is mounted over a suitable pulley indicated at 63 rotatably mounted at the upper ends of each of the respective upright guide columns. The pulleys 63 can be mounted in any conventional manner, and usually are rotatably mounted on the upper ends of the guide columns. If desired the pulleys 63 can even be mounted to the rafters of the home in which the swimming pool cover is used.

Figure 1:
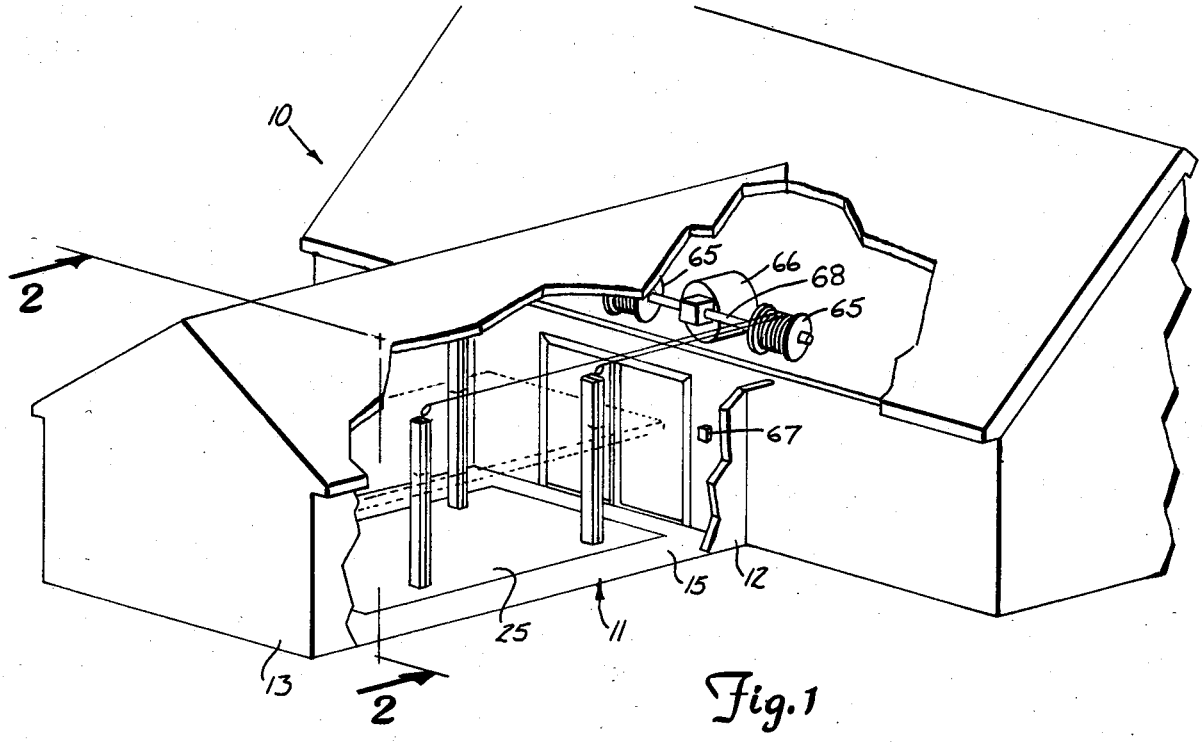
FIG. 1 is a fragmentary perspective view of a home having a room in which an in-ground indoor pool is placed, and which has a pool cover made according to the present invention installed therein.

Each of the pulleys 63, in turn, guides its respective cable 51 to a horizontal length that extends to selected winch drums, indicated in FIG. 1 generally at 65. The winch drum 65 (there can be two or four as desired, just so the cables are wound up evenly) is driven from a motor-gear reducer unit indicated generally at 66 of a conventional design that can be powered from a suitable switch, for example a switch indicated at 67 on the wall of the room in which the pool cover 25 is used.

By driving the motor 66, the shaft 68 will be rotated to rotate the winch drums 65 and wind up the cables onto the winch drums, or unwind them depending on the direction of rotation of the motor 66. The cables 51 from two pulleys 63 on the same side of the pool may be combined into a single cable leading to the winch drums.

Suitable gear reduction can be achieved by using a four hundred to one gear reducer for the motor 66 and directly driving the winch shafts. If additional reduction is required, jack shafts can be used for obtaining the necessary speed reduction to insure that the cables will be winched up or down evenly, and under adequate power.

Figure 9:
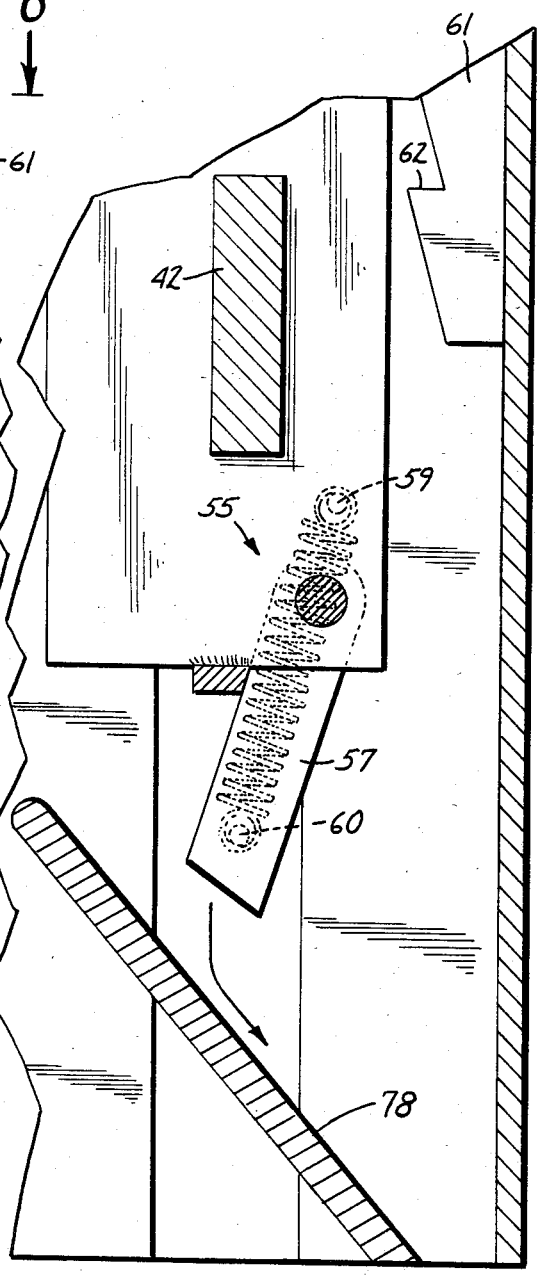
FIG. 9 is a side sectional view showing a lower reset plate for the safety latch of FIG. 7.

As shown in FIGS. 7, 8 and 9, the safety latch mechanism 55 can be reset in two different positions as the spring 58 tends to go over center with respect to the axis of the pivot of the dog 57.

In its working position as shown in FIG. 5, the spring 58 is past the center of the axis of pin 56 so that the lower end of the dog is urged against the rack teeth 62, and it will remain in this position until the pool cover is desired to be lowered. Then the pool cover is raised all the way up to adjacent its uppermost position where a pivoting dog member indicated generally at 70 (FIGS. 7 and 8), which is mounted on a pivot pin 71 supported on the rack on one end and on one of the side walls of the upright guide member 27 at the other end, will be engaged by the outer end of laterally extending pin 60, which is the pin that carries one end of the spring 58 for the latch dog 57. As the swimming pool cover is lifted, the pin 60 will engage the lower end of dog 70 as shown in dotted lines in FIG. 7, and the dog 70 will pivot about the pin 71, moving pin 60 outwardly and forcing the latch dog 57 to pivot outwardly as indicated by the arrow 75, until the spring 58 goes over center with respect to the axis of the shaft 56, at which time the latch dog will be pivoted in the same direction of arrow 75 by the spring 58. A stop 76 may be provided, or the dog 57 can pivot until spring 58 loses its tension. The spring 58 can be selected in length so that the latch dog will not move a substantial distance. The latch dog is held out of the way of the ratchet teeth on the rack 61, and in a position where it will permit the swimming pool cover to be lowered by reverse operation of the winch.

It should be noted that safety switches can be provided so that when the carriage for the cables reaches the uppermost position the winch motor will be shut off automatically when the switch is engaged. This can be ordinary limit switch of suitable design.

The swimming pool cover 25 can be therefore lowered after the latches 57 have been disabled. Tension will be carried on the cables 51 from the load of the pool cover as the pool cover is lowered. The bell crank 47 and dog 49 thereof will continue to clear the ratchet teeth 62 unless the pool cover hangs up or a cable 51 breaks.

In order to make the safety latch assembly 55 operable again and reset dog 57, when the swimming pool cover 25 is near its lowermost position with the upper surface thereof flush with the floor, an actuator plate shown in FIG. 9 at 78 is provided in each of the guide columns 27 and the latch dogs 57 will engage and slide along the plates 78 to a position wherein the spring 58 will go over center again, urging the latch dog 57 toward the rack 61 and teeth 62 so that as the swimming pool cover is again lifted the safety latch will be operable.

The swimming pool cover assembly 25 has a waterproof lower liner 80 on its under surface that prevents moisture from being evaporated into the room air, and also preferably the liner 80 on the bottom surface of the swimming pool cover would be mildew resistant to reduce any problems with fungus.

The individual guide columns that are spaced, and preferably at the sides of the swimming pool cover provide adequate protection against swaying and catching, and stabilize the swimming pool cover during its movement. A gasket 81 (FIG. 3) may be suitably placed around the support surface of the recess to prevent moisture from escaping when the cover is closed. The liner used on the bottom of the pool cover also adequately blocks moisture passage when it rests on the surface defining the recess 20 around the pool, so a gasket is not normally needed.

It should also be noted that while I beams are shown for forming the pool cover support member, trusses of suitable design and strength also can be used.

Although the present invention has been described with reference to preferred embodiments, workers skilled in the art will recognize that changes may be made in form and detail without departing from the spirit and scope of the invention.

What is claimed is:

1. In combination with a building structure defining an interior room and having a floor and a roof, a swimming pool recessed at a level below the floor, the floor having a recessed surface portion surrounding the perimeter of the swimming pool and recessed below the normal plane of the floor, the improvement comprising a pool cover for fitting within said recess in the floor and forming an upper surface generally coplanar with the normal plane of the floor when in position adjacent the pool and including:

hoist means mounted with respect to the roof of such building structure for lifting said pool cover from a first lowered position wherein it is positioned within said recess to a second position where it is raised substantially above the normal plane of the floor to provide for space beneath the pool cover for use of the swimming pool;

vertical guide columns fixed with respect to and extending upwardly from the floor toward the roof and providing guides for the pool cover as it is moved between its raised and lowered positions, the guide columns being mounted within the periphery of the pool cover and slidably mounted in openings defined in said pool cover, and said vertical guide columns comprising vertical members defining slots, said slots extending completely through the guide columns;

retainer arms extending through said slots of at least one column and fixedly mounted at opposite ends thereof on said pool cover to prevent substantial rotation of the pool cover about a vertical axis as the pool cover is raised and lowered along said guide columns; and a separate flexible elongated tension carrying member associated with each column and positioned on the interior thereof, the tension carrying member having first ends coupled to the pool cover and second ends coupled to the hoist means.

2. The apparatus as specified in claim 1, said pool cover being constructed of a plurality of cross beams and a covering over the cross beams, said cross beams being supported on the recessed area to support the covering for use as a floor when the pool cover is in its lowered position and a waterproof liner means lining the undersurface of the pool cover.

3. In combination with a building structure defining an interior room and having a floor and a roof, a swimming pool recessed at a level below the floor, the floor having a recessed surface portion surrounding the perimeter of the swimming pool and recessed below the normal plane of the floor, the improvement comprising a pool cover for fitting within said recess in the floor and forming an upper surface generally coplanar with the normal plane of the floor when in position adjacent the pool and including:

hoist means mounted with respect to the roof of such building structure for lifting said pool cover from a first lowered position wherein it is positioned within said recess to a second position where it is raised substantially above the normal plane of the floor to provide for space beneath the cover for use of the swimming pool;

vertical guide columns fixed with respect to and extending upwardly from the floor toward the roof and providing guides for the pool cover as it is moved between its raised and lowered positions, the guide columns being mounted within the periphery of the pool cover and slidably mounted in openings defined in said pool cover;

a plurality of cables, one associated with each vertical column, pulley means at the upper end of each of said vertical columns, and said cables being mounted over said pulley means, so a portion of each cable is on the interior of the associated column, a first end of each cable being coupled to the pool cover and a second end of each cable being coupled to the hoist means, and said hoist means including a powered winch mounted relative to said roof laterally offset from the swimming pool and operable to extend and retract the cables, said roof including rafters, and a ceiling supported on the lower edges of the rafters, said cables extending to the winch from the vertical columns at location above the ceiling; and safety latch means comprising a ratchet and dog mounted on each of said upright columns and adjacent portions of said swimming pool cover for permitting one direction of movement when the latch means are operable, said ratchet and dog means being effective along a substantial portion of the length of the vertical columns.

4. The apparatus as specified in claim 3 and means to move the dog of the safety latch means to a position not engaging the ratchet when the pool cover has been raised to a predetermined height.

5. The apparatus of claim 4 wherein the ratchet teeth are mounted on the respective vertical guide columns and are regularly spaced at tooth intervals along a substantial portion of the length of the vertical guide columns, and second safety catch means associated with each vertical guide column and comprising a separate second latch dog on the pool cover associated with each vertical guide column biased toward a position engaging the respective ratchet teeth on the associated vertical guide column, each of the second latch dogs being held away from its associated ratchet teeth in response to tension loads on a separate one of the plurality of cables associated with the respective column.

6. A swimming pool cover assembly for use in an interior room having a roof and a pair of oppositely spaced substantially parallel walls, and being enclosed at the ends of said parallel walls, and a floor extending between the walls, said floor having an opening therein opening to a swimming pool below the surface of the floor comprising:

a plurality of upright guide members spaced at desired locations around the perimeter of said swimming pool and extending upwardly;

a swimming pool cover comprising a deck capable of supporting people slidably mounted for vertical movement on said upright guide members and having guide means coupled thereto adjacent the upright guide members;

power means for raising and lowering said swimming pool cover along said guide members;

means to support the swimming pool cover with its upper surface substantially parallel with the floor surface to overlie the swimming pool to provide a floor support when it is in its position overlying the swimming pool;

first safety ratchet and dog means mounted on each of said upright guide members and portions of said pool cover guide means, and preventing reverse movement of the swimming pool cover in downward direction while the swimming pool cover is being raised in vertical direction, the ratchet and dog means being operable along a substantial portion of the length of the upright guide members; and means to release the first safety ratchet and dog means when the swimming pool cover has been raised to a predetermined height, and reset the safety ratchet and dog means to operable position when the swimming pool cover is lowered to position to provide a floor support.

7. The apparatus as specified in claim 6 wherein said upright guide members comprise vertical members having transversely opening slots defined therethrough, and said guide means comprising second guide members extending through said slots and mounted on said swimming pool cover to prevent substantial rotation of the swimming pool cover about a vertical axis as the swimming pool cover is raised and lowered along said vertical member.

8. The apparatus as specified in claim 7 wherein said vertical guide members comprise an interior chamber, and the means for raising and lowering said swimming pool cover comprises a plurality of cables, one cable being associated with each vertical guide member and extending on the interior thereof, means to couple each cable to an associated second guide member, pulley means at the upper end of each of said vertical guide members, said cables being threaded over said pulley means, and a winch mounted relative to said roof laterally offset from the swimming pool.

9. The apparatus as specified in claim 6 wherein said floor has a recessed perimeter area which forms a support surface around the perimeter of the pool opening, and said swimming pool cover having support members to engage the support surface of the recess and support the upper surface of the swimming pool cover substantially coplanar with the normal floor surface.

10. The apparatus of claim 9 wherein the swimming pool cover has framing members defining an opening for each upright guide member, said framing members closely fitting around the respective upright guide member to guide the swimming pool cover.

11. A swimming pool cover assembly for use in an interior room having a roof and a pair of oppositely spaced substantially parallel walls, and being enclosed at the ends of said parallel walls, and a floor extending between the walls, said floor having an opening therein opening to a swimming pool below the surface of the floor comprising:

a plurality of upright guide members spaced at desired locations around the perimeter of said swimming pool and extending upwardly;

a swimming pool cover comprising a deck capable of supporting people slidably mounted for vertical movement on said upright guide members;

power means for raising and lowering said swimming pool cover along said guide members comprising a plurality of flexible tension carrying members for lifting the pool cover, one flexible tension carrying member being associated with each upright guide member;

means to support the swimming pool cover with its upper surface substantially parallel with the floor surface to overlie the swimming pool to provide a floor support when it is in its position overlying the swimming pool;

a plurality of safety ratchet teeth fixedly mounted on each upright guide member and extending at spaced intervals along a substantial length of each upright guide member; and means to couple each flexible tension carrying member to a respective portion of the pool cover adjacent the upright guide member comprising a separate pivoting latch dog mounted with respect to the pool cover adjacent each upright guide member biased toward the respective ratchet teeth and engageable therewith to prevent downward movement of the pool cover at each of the plurality of ratchet teeth, and each latch dog having a portion connected to its respective flexible tension carrying member at a location wherein the latch dog is pivoted to a position to clear the ratchet teeth on the respective upright guide member when the flexible tension carrying member connected thereto is under tension, and to engage the respective ratchet teeth when the flexible tension carrying member is slack.

12. In combination with a building structure defining an interior room and having a floor and a roof, a swimming pool recessed at a level below the floor, the floor having a recessed surface portion surrounding the perimeter of the swimming pool and recessed below the normal plane of the floor, the improvement comprising a pool cover for fitting within said recess in the floor and forming an upper surface generally coplanar with the normal plane of the floor when in position adjacent the pool and including;

hoist means mounted on the roof of such building structure for lifting said pool cover from a first lowered position wherein it is positioned within said recess to a second position where it is raised substantially above the normal plane of the floor to provide for space beneath the cover for use of the swimming pool;

a plurality of vertical guide columns fixed with respect to and extending upwardly from the floor toward the roof and providing guides for the swimming pool cover as it is moved between its raised and lowered positions;

a separate flexible tension carrying member associated with each vertical guide column coupled between the hoist means and pool cover, the flexible tension carrying member being under tension when the pool cover is supported by the hoist means; and safety catch means including cooperating interconnecting elements on the vertical guide columns and pool cover, respectively, including a first member extending along a substantial portion of the length of the vertical guide columns and a second member mounted with respect to the pool cover and positioned to engage the first member to prevent downward movement of the pool cover, and means coupled to the respective flexible tension carrying member for retaining said second member from engaging the first member whenever the respective tension carrying member is under load from the pool cover, and permitting engagement of the first and second members when the respective tension carrying member is unloaded.

13. The apparatus of claim 12 and a separate third member mounted with respect to the pool cover adjacent each vertical guide column and biased to engage the first member of its associated vertical guide column when the third member is in a working position preventing downward movement of the pool cover, said third members being resettable to a retracted position clearing the respective first members, and means for moving the third members to working position when the pool cover is in its lowered position so the third members remain in working position as the pool cover is raised, and second means operable when the pool cover is raised to a desired height for resetting the third members to retracted position.

* * * * *